United States Patent [19]

Pizzino

[11] 4,234,000

[45] Nov. 18, 1980

[54] COMPOUND HAIR ROLLER

[76] Inventor: Carmine P. Pizzino, 251 Westminister Rd., Brooklyn, N.Y. 11218

[21] Appl. No.: 964,738

[22] Filed: Nov. 29, 1978

[51] Int. Cl.[3] ..... A45D 2/02

[52] U.S. Cl. ..... 132/39

[58] Field of Search ..... 132/40, 42, 39, 33

[56] References Cited

U.S. PATENT DOCUMENTS

| | | | |
|---|---|---|---|
| 2,429,176 | 10/1947 | Watson | 132/40 |
| 3,175,562 | 3/1965 | Reed | 132/39 |
| 3,400,724 | 9/1968 | Scott | 132/39 |
| 3,870,057 | 3/1975 | Pezzino | 132/39 |

FOREIGN PATENT DOCUMENTS

| | | | |
|---|---|---|---|
| 2000594 | 9/1969 | France | 132/40 |

*Primary Examiner*—G. E. McNeill

*Attorney, Agent, or Firm*—Howard C. Miskin

[57] ABSTRACT

A compound hair roller has two members one of which is of hollow cylindrical configuration and adapted to have a portion of a length of hair wound about it and a second member in the form of a hollow cylindrical shell of greater diameter than the first member and having a slot through which the first member can be inserted into the second member and fins for supporting the first member within the second member with the outer circumference of the first member and inner circumference of the second member being in spaced relationship to permit air to flow therebetween.

6 Claims, 4 Drawing Figures

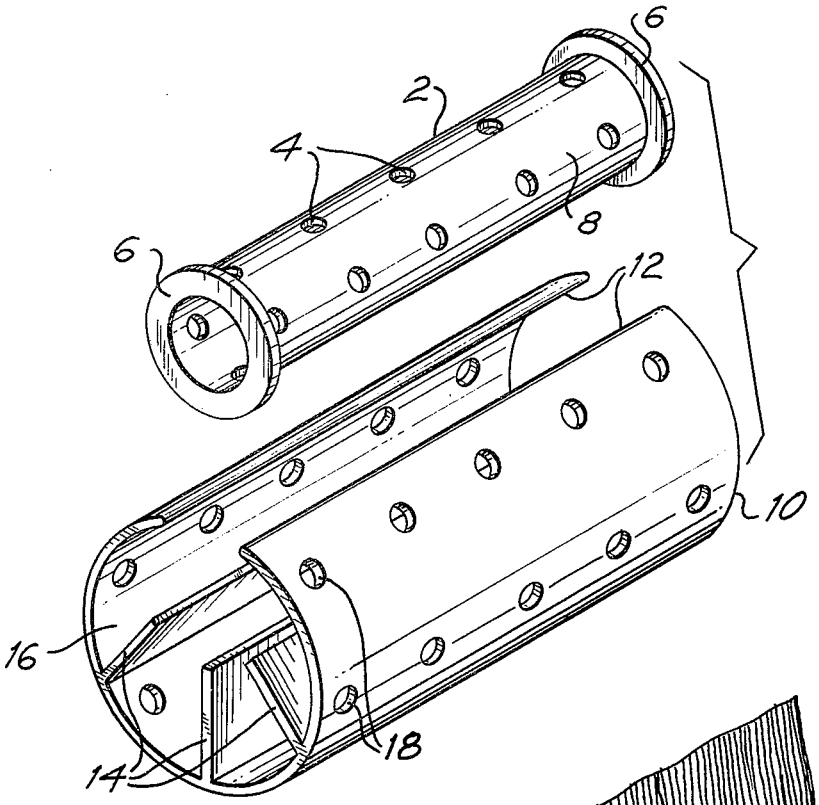
FIG. 1
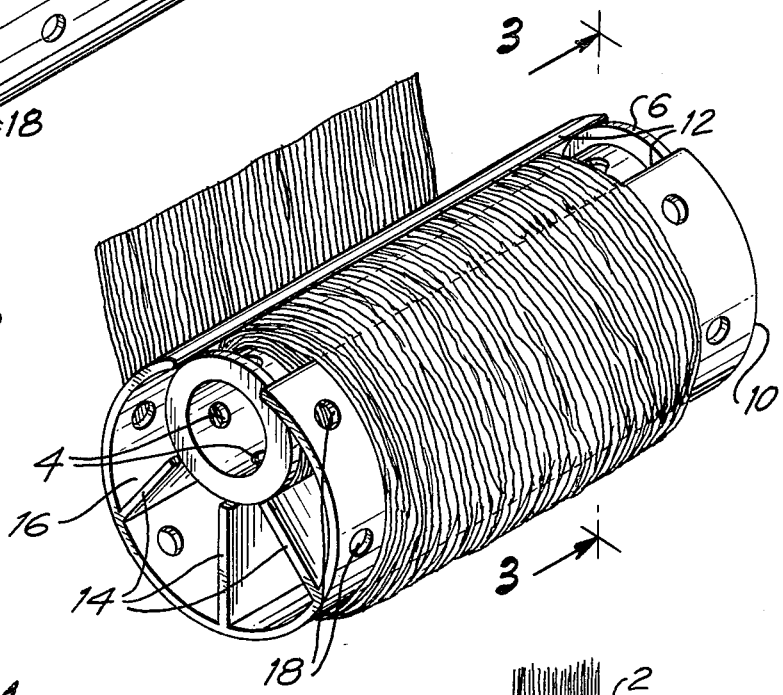
FIG. 2
FIG. 3
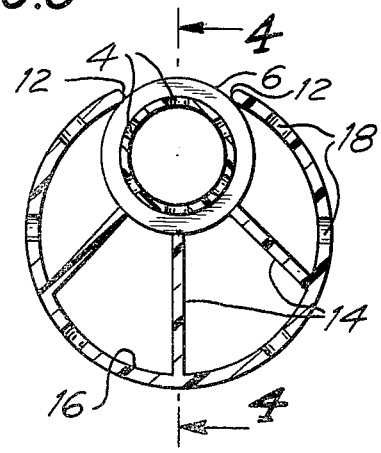
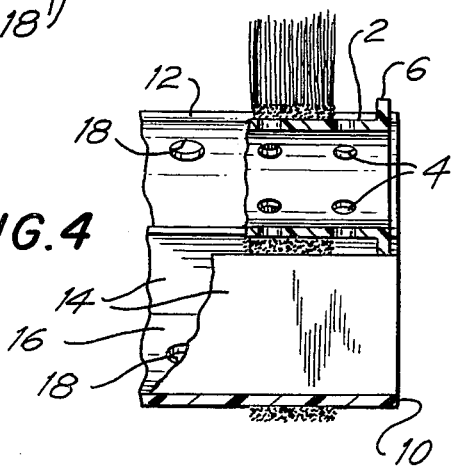
FIG. 4

COMPOUND HAIR ROLLER

BACKGROUND OF THE INVENTION

This invention relates to the curling and/or straightening of hair and particularly to a device for imparting two different degrees of curl or curl and straightening to a length of hair.

Apparatus is known for imparting two different degrees of curl or curl and straightening to a length of hair wherein a portion of the length of hair is first wound about a roller of small diameter which is then placed within a larger diameter roller with the remainder of the length of hair wound about the larger roller with the smaller roller contained therein. In one such device the smaller roller is provided with ears extending from either end for supporting the smaller roller on the outer circumference of a larger roller when the smaller roller is inserted into a window within the cylindrical wall of the larger roller. In devices of this type there is no positive means for maintaining the smaller roller within the larger roller thereby permitting relative movement of the smaller and larger rollers and making it difficult for the hair to be properly wound on the rollers. In addition the necessity of providing ears on the smaller roller and leaving closed portions on either side of the window in the larger roller, in which the smaller roller is disposed, for supporting the ears of the smaller roller makes such devices costly to fabricate.

U.S. Pat. No. 3,870,057 for Hair Roller which issued to the inventor named herein discloses an improved roller combination wherein a smaller roller is received in a partially circular channel formed on the periphery of a larger roller. Although permitting positive engagement between the smaller and larger rollers the clearance between the rollers is less than desirable for promoting maximum ventilation for rapid drying of the hair.

SUMMARY OF THE INVENTION

The instant invention overcomes the problems of prior art rollers and roller combinations in permitting positive engagement between a small diameter roller and a complementary larger diameter roller without relative movement between them while permitting air to flow between the rollers to enhance drying of the hair curled about them. Specifically, the invention teaches the construction of apparatus for curling hair including a first member of hollow cylindrical construction adapted to receive a portion of a length of hair wound about its circumference and a second cylindrical member of larger diameter than that of the first member and having a longitudinal slot in its wall for admitting at least part of the smaller member to the interior of the larger member and a plurality of projections on the inner surface of the cylindrical wall of the larger member for supporting the smaller member while permitting air to flow between the projections and between the outer and inner walls of the smaller and larger members respectively.

It is therefore an object of the invention to provide apparatus for curling a length of hair including a roller of small circumference for permitting a portion of the length of hair to be wound thereon and a roller of larger circumference for receiving the smaller roller and permitting the remainder of the length of hair to be wound thereon.

Another object of the invention is to provide apparatus for curling a length of hair wherein a smaller roller is supported on a plurality of projections within a larger roller for permitting enhanced ventilation for rapid hair drying.

Still another object of the invention is to provide apparatus for curling a length of hair wherein a small roller member with hair wound thereon can be held within a larger roller member in engagement with the edges of a plurality of fins extending from the interior surface of the larger member and the confronting edges of the resilient slotted wall of the larger member.

A further object of the invention is to provide an apparatus for curling a length of hair wherein a small roller member is provided with portions of enlarged diameter for being supported within a larger roller member so that the surface of the smaller roller on which a portion of the length of hair is wound does not engage any surface of the larger member.

Other and further objects of the invention will be apparent from the following drawings and description of a preferred embodiment in which like reference numerals are used to designate like parts in the various views.

DESCRIPTION OF THE DRAWINGS

FIG. 1 is a perspective view of the preferred embodiment of the invention with the two components of which that embodiment is comprised separated.

FIG. 2 is a perspective view of the assembled apparatus of the preferred embodiment of the invention in its intended enviroment.

FIG. 3 is a sectional end view of the apparatus of the preferred embodiment of the invention taken through line 3—3 of FIG. 2.

FIG. 4 is a sectioned frontal elevation of the apparatus of the preferred embodiment of the invention taken through line 4—4 of FIG. 3.

DESCRIPTION OF THE PREFERRED EMBODIMENT

Referring now to FIG. 1 of the drawings there is shown a hollow cylindrical roller member 2 having apertures or perforations 4 in its circumference and terminating at either end in circular flanges 6. The cylindrical member 2 is suitable for receiving a portion of a length of hair which can be wound about its outer cylindrical surface 8. The perforations 4 permit air to flow between the inner and outer surfaces of the cylindrical wall of the roller member 2 to promote rapid drying of the hair wound about the roller 2.

A second cylindrical shell-like roller member 10 has a longitudinal slot in its wall defining confronting edges 12 of the wall and convergingly inwardly directed fins 14 projecting transversely from the interior surface of the cylindrical wall 16 of the roller member 10. The circumference of the roller member 10 is substantially greater than the circumference of the roller member 2 and the circumferences of the flanges 6 on the ends of the roller member 2. The normal distance separating the confronting edges 12 of the wall of the roller member 10 is normally less than the maximum diameter of the roller member 2. The flanges 6 are separated by a longitudinal distance no greater than the length of the roller 10 and the projections or fin members 14. In the preferred embodiment shown in FIG. 1 the flanges 6 comprise the largest diameter portions of the roller member 2 and the width of the slot in the roller member 10 which is defined as the distance between the confronting edges 12 of the cylindrical wall portion of the roller member 10 is slightly less than the diameter of the flanges 6.

The roller member 10 is preferably formed from a resilient metal or plastic or other material having properties which permit the confronting edges 12 of the roller member 10 to be urged apart to a distance equal to or slightly greater than the maximum diameter of the smaller roller member 2 to permit the roller member 2 to be admitted through the slot in the wall of roller member 10 to the interior thereof and to engage the edges of the projections or fins 14 as best seen in FIGS. 2, 3 and 4. The confronting edges 12 and the edges of the fins 14 positively engage the respective circumferences of the flanges 6 when the smaller roller member 2 is urged through the slot in and into the larger roller member 10 as shown in FIG. 2. With the smaller roller member 2 inserted in the larger roller member 10 as shown in FIG. 2 the edges 12 of the wall of the larger roller member 10 are resiliently urged against the circumferences of the flanges 6 thereby preventing relative movement between the smaller roller member 2 and larger roller member 10.

The larger roller member 10 is also perforated as at 18 and open at both of its ends to permit air to flow between the inner wall 16 of the larger roller member 10 and outer wall 8 of the smaller roller member 2. The smaller roller member 2 is also open at both ends to promote ventilation therethrough.

In use a portion of the length of hair to be curled or straightened is first wound on the smaller roller member 2 and the smaller roller member 2 with the hair so wound on it is then inserted into the larger roller member 10 as shown in FIG. 2. The remainder of the length of hair can then be wound about the combination of the smaller roller member 2 and larger roller member 10.

The larger roller member 10 serves as a retaining means for preventing the portion of the length of hair wound on the smaller roller member 2 from unraveling. To prevent the remainder of the length of hair wound about the combination of the smaller roller member 2 and larger roller member 10 from unraveling means (not shown) known to the art can be used such as a clip or standard hair pin or bobbie pin.

It is to be appreciated that alterations and variations of the preferred embodiment of the invention disclosed herein can be made without departing from the spirit and scope of the invention. For example the flanges 6 can be dispensed with and the edges 12 on the wall of the larger roller member 10 can engage the circumference of the smaller roller member 2 or the hair wound about the smaller roller member 2 directly. Also, instead of continuous longitudinal fins, discrete projections can be spaced along the interior wall 16 of the larger roller member 10 to support the smaller roller member 2. Other changes may be made to the disclosed preferred embodiment within the scope of the invention which is to be limited only by the following claims.

What is claimed is:

1. Apparatus for curling a length of hair comprising

A first member of hollow cylindrical configuration adapted to receive a length of hair wound about its circumference and a second member including a substantially cylindrical shell having a longitudinal slot in its wall defining confronting edges thereof and a plurality of peripherally spaced projections extending longitudinally along and projecting inwardly from the inner surface of said wall and terminating in free edges coinciding with a cylindrical surface, said wall being adapted to admit said first member at least partially through said slot and into engagement with said projections.

2. Apparatus according to claim 1 wherein the smallest width of said slot is normally less than the largest diameter of said first member and the wall of said second member is resilient for allowing said slot to be temporarily widened as said first member is admitted therethrough.

3. Apparatus according to claim 1 wherein said projections comprise enlongated fins.

4. Apparatus according to claim 3 wherein said fins are convergingly inwardly directed.

5. Apparatus according to claim 1 wherein said first member includes a flange disposed at each of its ends, said flanges engaging at least one of said projections and said confronting edges when said first member is disposed within said second member.

6. Apparatus according to claim 5 wherein said projections comprise elongated fins which are convergingly inwardly directed.

* * * * *